United States Patent [19]

Thomas

[11] Patent Number: 4,483,525

[45] Date of Patent: Nov. 20, 1984

[54] SAWBUCK

[76] Inventor: Richard Thomas, 10360 Occidental Rd., Sebastopol, Calif. 95472

[21] Appl. No.: 535,424

[22] Filed: Sep. 26, 1983

[51] Int. Cl.[3] ..... B65D 19/44

[52] U.S. Cl. ..... 269/295; 269/296

[58] Field of Search ..... 269/296, 293, 295; 211/60 R, 49 R, 69.5, 74; 248/187, 176, 512, 519, 520

[56] References Cited

U.S. PATENT DOCUMENTS

| | | | |
|---|---|---|---|
| 537,853 | 4/1895 | Ramsay | 211/49 R |
| 2,633,248 | 3/1953 | Goldenberg | 211/74 |
| 2,695,712 | 11/1954 | Kolander | 211/74 |
| 3,233,804 | 2/1966 | Dahm | 211/74 |
| 3,946,876 | 3/1976 | Jay | 211/60 R |

*Primary Examiner*—Robert C. Watson

*Attorney, Agent, or Firm*—Andrew A. Steiner

[57] ABSTRACT

The invention discloses a sawbuck. The sawbuck comprises a rectangular base, from the base there are upwardly projecting side walls, on two sides there is an outer and inner wall. The distance between the inner and outer walls define an opening, the said opening is for holding slats, the slats are positioned for holding logs, the logs are placed across the facing side walls in between the slats.

1 Claim, 3 Drawing Figures

SAWBUCK

BACKGROUND AND SUMMARY

All the sawbucks in the prior art comprise two pairs of crossed legs and a cross bar holding the pairs of legs together.

Examples of the prior art are the following:

U.S. Pat. No. 530,601 Palmer

U.S. Pat. No. 305,556 Wylie

U.S. Pat. No. 274,304 Floyd

The present invention comprises a rectangular base. Starting from the base there are upwardly projecting side walls, the said walls are tapered and slant inwardly. Two of the facing side walls are double and two facing side walls are single, the double walls have a narrow opening between the inner and outer walls, the two inner walls are vertical. The two inner walls define an opening at a distance from the base of the device. In the center of the openings between the inner and outer walls are triangular separators installed thus creating two slits in each facing double walls, the slits are for holding slats, the slats are slanted outwardly by the triangular separators, the two pairs of slats are aligned with each other. The logs to be cut are placed in between the slats and across the facing double walls.

OBJECTS AND ADVANTAGES

The primary object of the device is to cut logs with a chain saw. Some of the advantages of the device is that it can be loaded with a plurality of logs to be cut; the cut logs will fall on both sides to the ground. The logs are prevented from rolling during cutting. The logs can be completely cut through. Other objects and advantages will be apparent to those skilled in the art, from the detailed description and the drawings.

DETAILED DESCRIPTION

Figure 1:
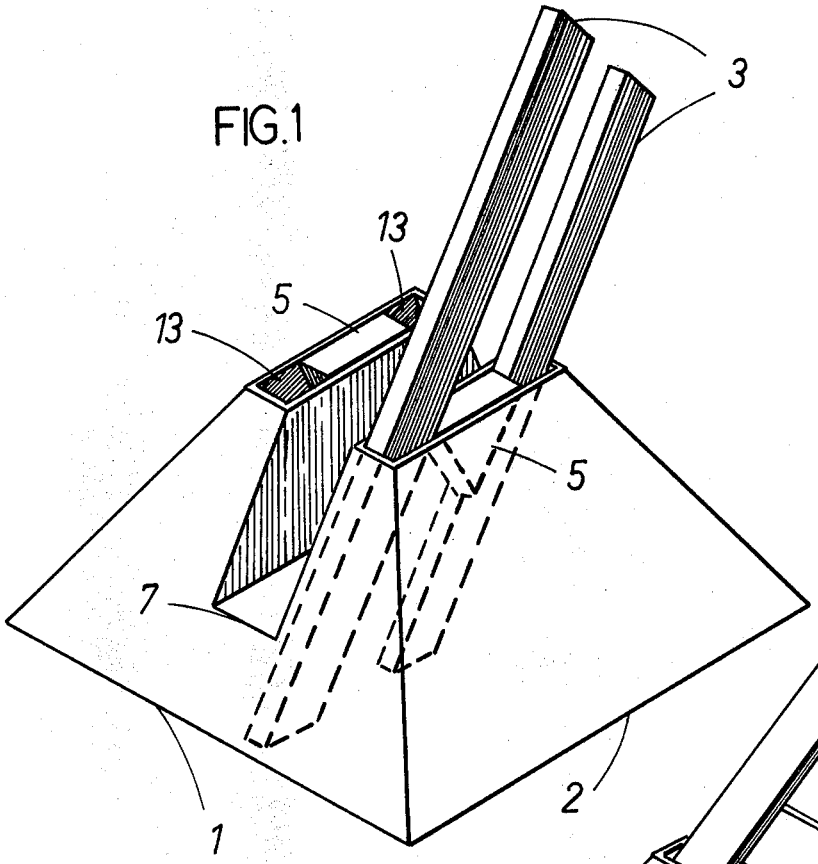
FIG. 1 is an elevated view of the device.
Figure 2:
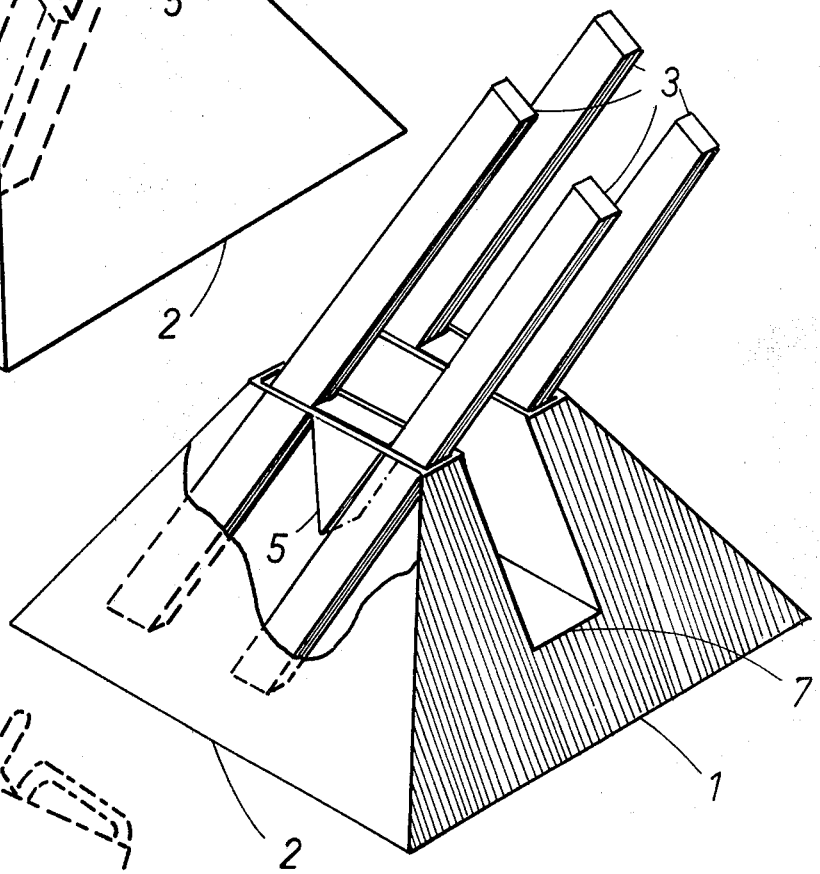
FIG. 2 is an elevated view of the device viewed from a side different from FIG. 1.
Figure 3:
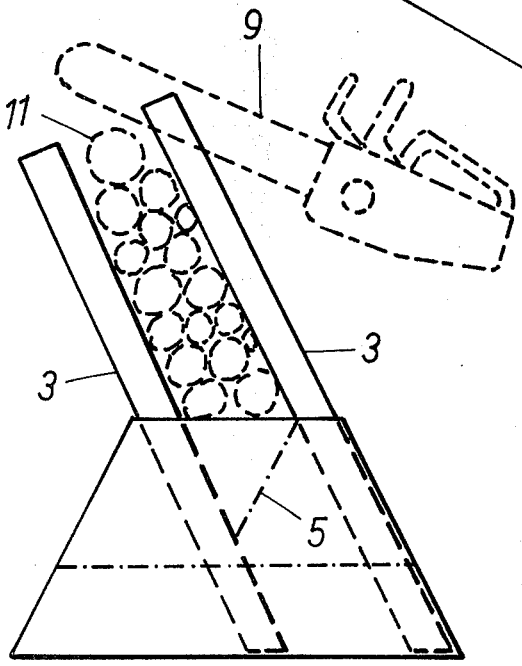
FIG. 3 is a cross sectional view of FIG. 2 along the lines 1—1.

Referring now to the drawings, the device comprises a base 1 and four walls, the said walls are tapered and slant inwardly. Two of the facing walls are double defining an opening between the outer wall 2 and inner wall 7. The other two walls are single and their center is open. The inner walls 7 are vertical. The distance between the said inner walls defines an opening between them. The opening between the two facing inner walls 7 has a floor 4. In the center of the space between the outer wall 2 and inner wall 7, a triangular separator 5 is installed. The separator 5 creates two slits in each of the facing double walls. The slits are for holding firmly slats 3, because of the triangular shape of the separators 5 the slats 3 slant outwardly. The slats 3 are removable and slats of various heights are provided which are interchangeable.

I claim:

1. A sawbuck comprising a rectangular base, from said base there are two upwardly projecting facing double walls defining an opening between the facing walls, the double walls include outer and inner walls, a narrow opening is formed between the said outer and inner walls for holding two slats; the said slats are held firmly in said narrow opening by a triangular separator installed between the said inner and outer walls, the outer walls slant upwardly and inwardly from said base; two additional walls slant upwardly and inwardly from said base; the center portion of the additional walls include a cut out portion avoiding the closure of the opening between the facing double walls.

* * * * *